US007178247B2

(12) United States Patent
Currie

(10) Patent No.: US 7,178,247 B2
(45) Date of Patent: Feb. 20, 2007

(54) SPOON APPARATUS AND METHOD

(76) Inventor: Phillip Currie, 6905 Oslo Cir., #F, BuenaPark, CA (US) 90621

( * ) Notice: Subject to any disclaimer, the term of this patent is extended or adjusted under 35 U.S.C. 154(b) by 442 days.

(21) Appl. No.: 10/848,671

(22) Filed: May 19, 2004

(65) Prior Publication Data

US 2005/0257381 A1 Nov. 24, 2005

(51) Int. Cl.
*B26B 1/04* (2006.01)

(52) U.S. Cl. ..... 30/324; 16/110.1; 414/9

(58) Field of Classification Search ..... 30/324
See application file for complete search history.

(56) References Cited

U.S. PATENT DOCUMENTS 2,636,266 A * 4/1953 Sweet ..... 30/324
2,741,027 A * 4/1956 Margolin ..... 30/324
4,028,803 A * 6/1977 Currie ..... 30/321
6,393,704 B1 * 5/2002 Tompkins et al. ..... 30/324

* cited by examiner

*Primary Examiner*—Kenneth E. Peterson
*Assistant Examiner*—Sean Michalski
(74) *Attorney, Agent, or Firm*—Terry L. Miller

(57) ABSTRACT

An improved spoon apparatus and method includes a handle portion carrying a spoon bowl portion. The spoon bowl is clutched non-rotationally to the handle portion during a scooping motion to load the spoon bowl with food. At the initiation of the food scooping motion, essentially immediate clutching of the spoon bowl to the handle portion is effected by a fine-dimension ratchet structure of the inventive spoon. However, as soon as the scooping motion is completed by clearing of the spoon bowl from the food, the bowl portion is unclutched from the handle portion and becomes freely pivotal like a pendulum so as to remain level from side to side irrespective of rotation of the handle portion as a user moves the loaded spoon to the user's mouth. A unique combination of gravitationally induced torque as well as a gravitational force vector are utilized to effect unclutching of the spoon bowl from the handle portion.

12 Claims, 2 Drawing Sheets

SPOON APPARATUS AND METHOD

FIELD OF THE INVENTION

The present invention relates to improvements in a spoon having a handle portion and a spoon bowl portion connected by a rotational mechanism and a selectively operable clutching mechanism. The rotational mechanism allows the spoon bowl to swing freely like a pendulum below and relative to an axis passing longitudinally along the handle portion. The selectively operable clutching mechanism engages the handle portion and the bowl portion in response to axial force and torque resulting from a user scooping up food. When the user lifts the food on the spoon, the clutching mechanism is responsive to a combination of torque and the gravitational vector to unclutch and allow the bowl portion to swing freely relative to the handle portion. As a result, those who have undeveloped or impaired coordination enjoy greater success in using the spoon to feed themselves.

BACKGROUND OF THE INVENTION

A variety of improved spoons have been made in order to facilitate use by individuals with undeveloped or impaired coordination (i.e., infants or stroke victims, for example). These spoons are intended to allow infants, the elderly, and the disabled to participate more fully in feeding themselves.

Improvements in conventional spoons of this character sometimes relate to weighting or texturing or configuring the handle (See, for example, U.S. Pat. No. 4,389,777), such that the handle is more easily grasp or manipulated. This expedient does not address the undeveloped or impaired coordination that may prevent the user from being able to accomplish leveling of the spoon bowl so that food does not fall off the side of the spoon. The user may not even be aware of the need for or their inability to accomplish leveling of the spoon bowl.

Other improved conventional spoons simply allow the bowl portion to swing freely like a pendulum relative to the handle (See, U.S. Pat. No. 6,393,704), and it is known to add additional weighting to the bowl portion or to a shaft carrying the bowl portion to increase the pendulum action (i.e., self leveling action) of the spoon bowl. This conventional expedient makes such a spoon a very difficult utensil when it is desired to scoop up food onto the spoon. Even a person with perfectly normal coordination in attempting to use such a spoon will find that the utensil is frustrating and requires a special concentration and coordination in order to scoop up food into the freely swinging spoon bowl. Such a utensil is very frustrating for those with undeveloped or impaired coordination.

Other conventional improved spoons add various versions and arrangements of clutches to momentarily engage (rotationally lock for movement in unison) the spoon bowl to the handle to improve the action of the spoon in scooping up food (See, for example, U.S. Pat. Nos. 2,636,266; 2,741,027; 4,028,803; 4,993,156; and 5,630,276). Some of these clutches or locking mechanisms are to be manually operated, which may be beyond the understanding of an infant, or beyond the physical ability of the impaired. Other clutch mechanisms are intended to engage and disengage in response to the forces, angulations, and rotations of a spoon in use. U.S. Pat. No. 2,636,266 is an example of this intention. However, consideration of FIG. 2 of the '266 patent will show that the spoon must be pushed into the food in an unnatural way in order to get that particular clutch mechanism to engage. If the spoon is used in a natural scooping motion, the clutch will disengage at the time when the user would want it to be engaged. Once the bowl of the spoon is loaded with food, the clutch of the '266 patent would appear to unclutch as desired, as is seen in FIG. 5 of this patent. Consideration of the operation of the '266 patent makes clear that any clutching mechanism must not only disengage when desired once the spoon bowl is loaded with food, but must also engage in response to the most natural scooping motions that a user will make in attempting to use the spoon.

Another spoon including a clutch mechanism attempts to use a spring-loaded mechanism in order to effect clutching and unclutching of the spoon bowl and handle (See, for example, U.S. Pat. No. 2,741,027). However, these mechanisms are subject to sticking and fouling either on their own or as a result of food entering the mechanism. Some spoons of this character require angulation or tipping of the handle portion to effect clutching and unclutching (See my own U.S. Pat. No. 4,028,803, for example). Still other spoons of this character add manual clutch operating features (such as a clutch operated by a thumb pad) or have exterior protrusions, levers, or bob weights, all of which are not desirable for use by an infant or the impaired.

SUMMARY OF THE INVENTION

In view of the above, an object for this invention is to reduce or eliminate the effect of one or more of the deficiencies of the conventional art.

In accordance with the principles of the present invention, an improved spoon includes an elongate handle portion defining a longitudinal axis; a spoon bowl portion having a shaft part; and a rotational and clutching apparatus connecting the handle portion and the spoon bowl via the shaft part so that the spoon bowl is relatively rotationally supported below the longitudinal axis. The rotational and clutching apparatus further is responsive to a certain user input to clutch the spoon bowl to the handle portion to resist torque in only a single direction, and the rotational and clutching apparatus is responsive to torque in an opposite direction to unclutch allowing the spoon bowl to freely rotate about the longitudinal axis.

These and other features and advantages of the present invention will be readily apparent from a thoughtful consideration of the following detailed description of one exemplary embodiment of the invention. This detailed description will be better understood in conjunction with the accompanying drawings, wherein like reference characters represent like elements, as follows:

BRIEF DESCRIPTION OF THE DRAWING FIGURES

Figure 4:
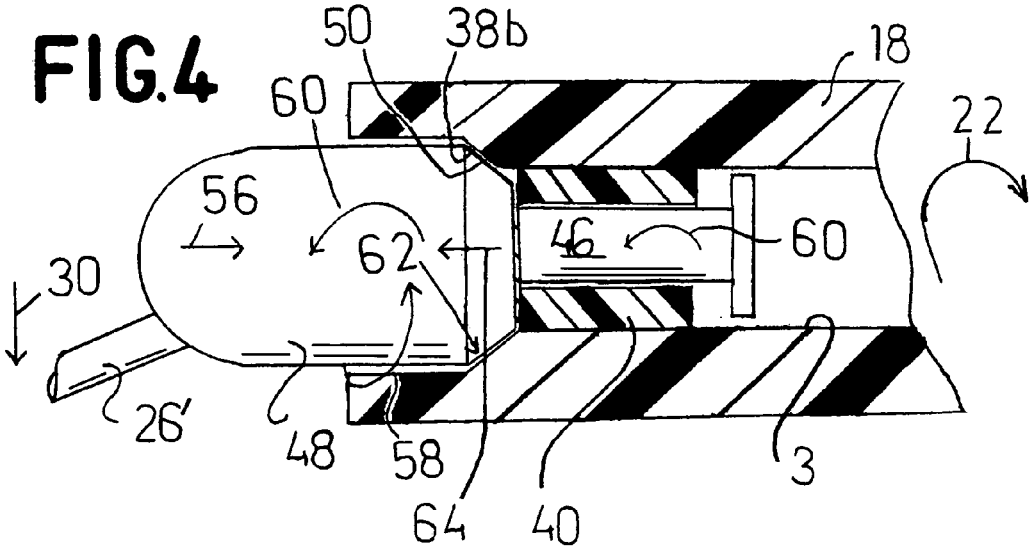
FIG. 4 is a side elevation assembly view, at a still more greatly enlarged size in comparison to that of FIG. 3, and partially in cross section, showing the rotational and clutching mechanisms of the inventive spoon.
Figure 5:
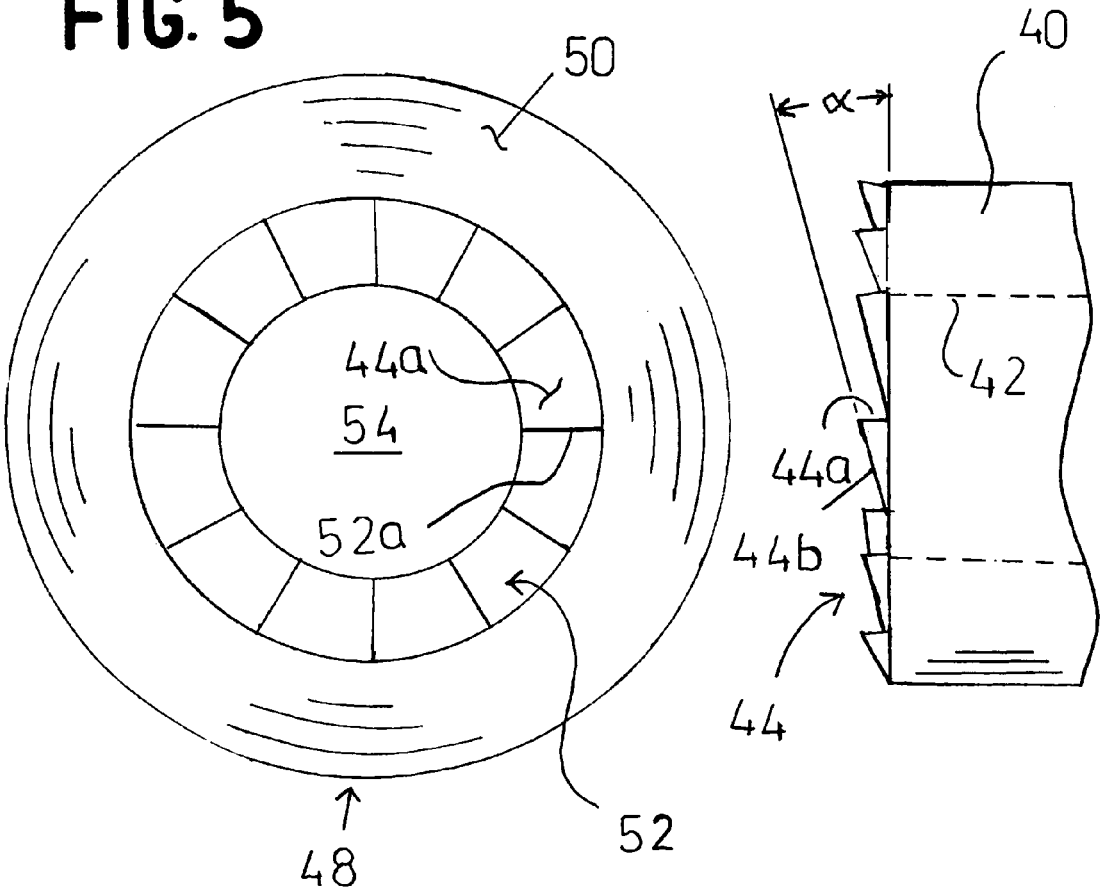

FIG. 5 is view combining a side view and an axial view of portions of the spoon seen in FIG. 4, and at a still more greatly enlarged size compared to FIG. 4, so as to show details of the rotational and clutching mechanism according to this invention, and with the element in the left-hand side of this Figure rotated 90° to face the viewer in axial view so as to better illustrate details of the structure.

DETAILED DESCRIPTION OF AN EXEMPLARY PREFERRED EMBODIMENT OF THE INVENTION

Figure 1:
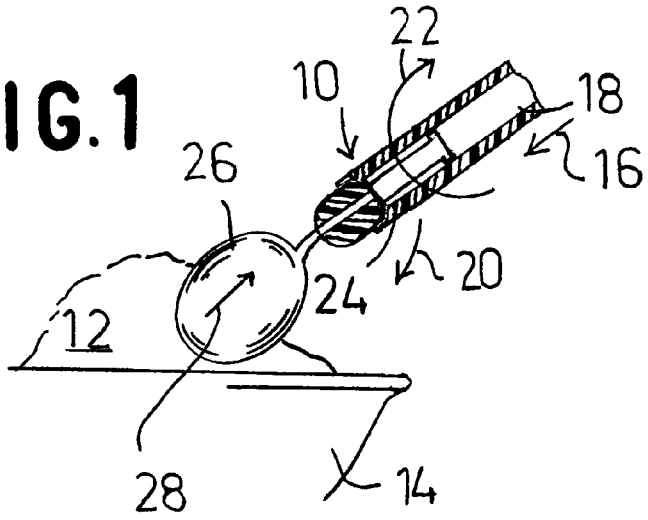
FIG. 1 is a fragmentary perspective view partially in cross section of an exemplary spoon according to this invention being used to scoop up food from a bowl.

An improved spoon 10 according to the present invention is illustrated in FIG. 1. The improved spoon is shown in FIG. 1 as it would appear when held in the right hand of a user (not seen in the drawing Figures) while being used to scoop up food 12 from a bowl 14. As is seen in FIG. 1, the natural scooping motion for a spoon held in the right hand is downwardly and into the food (illustrated by axial arrow 16 along the axis of a handle portion 18 of the spoon 10) with the user drawing the spoon 10 toward the user (illustrated by arcuate arrow 20—this arrow being directed generally out of FIG. 1 toward the viewer of this Figure) and possibly in combination with a rotation of the handle portion 18 in a clockwise direction (indicated by rotational arrow 22). This relative rotation indicated by arrow 22 results most naturally from articulation of the users elbow and shoulder as the right hand holds the spoon 10 while this spoon is drawn into and through the food 12 toward the user. As these motions are conducted by the user of the spoon 10 a rotational and clutching mechanism (generally indicated with arrowed numeral 24) within the handle 18 of spoon 10 clutches the bowl portion 26 to the handle 18 in order to allow torque to be applied in the direction indicated by arrow 22.

Of course, it is understood that these motions are not distinct and discreet, but occur in combination with one another essentially as a single scooping motion by the user of the spoon 10. FIG. 1 also shows that as a reaction to the downward motion 16 of the spoon 10 into the food 12, the bowl portion 26 of the spoon experiences an axially directed reaction force, indicated by arrow 28. It will be seen that a very early and initial result of this reaction force is the engagement of rotational and clutching mechanism 24 in order to sustain clockwise torque 22.

Figure 2:
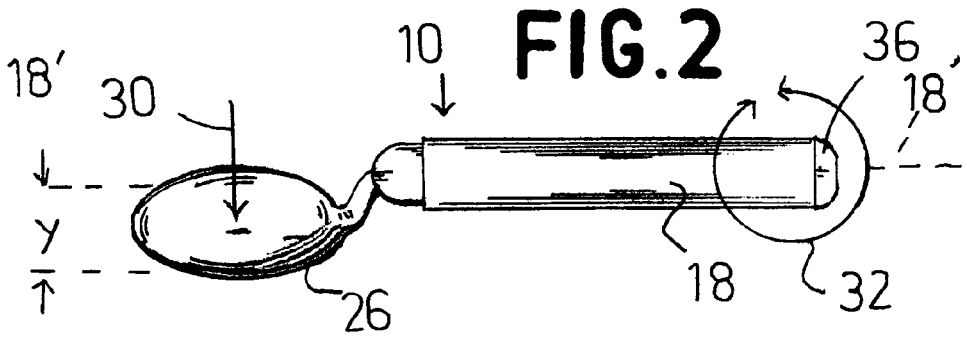
FIG. 2 is a side elevation view of the improved spoon seen in FIG. 1.

That is, during the scooping motion indicated in FIG. 1, it is desirable to have the handle portion 18 clutch to the bowl portion 26 so that the user may more effectively scoop up food 12 onto this bowl portion 26 of the spoon. However, as is seen in FIG. 2, once the user has loaded the bowl portion 26 of the spoon 10 with food (indicated by the weight arrow 28) and lifted the spoon 10 free of the food 12, then it is desirable to have the handle portion 18 and bowl portion 26 be freely rotational relative to one another, as is indicated by bi-directional arrow 32. The bi-directional arrow 32 indicates that the handle portion 18 is freely rotational in both directions about an axis 18' relative to the bowl portion 26. Accordingly, as a result of an offset (indicated by vertical distance Y) of the bowl portion 26 below the axis 18' of handle 18, the weight of the bowl portion 26 in combination with the food held in this bowl portion (recalling weight arrow 28) causes the bowl portion 26 to swing or rotate freely like a pendulum about axis 18' as the user moves the spoon toward the users mouth. Thus, even though the user may have undeveloped or impaired fine motor coordination of the fingers and wrist, the motions of the user's elbow and shoulder in moving the spoon to the user's mouth will be sufficient. And, rotational motion of bowl portion 26 relative to handle portion 18 will essentially prevent food from spilling off the spoon 10.

In order to achieve the necessary automatic clutching and unclutching of the bowl portion 26 and handle portion 18 (recalling FIGS. 1 and 2), in conjunction with the free rotational relationship desired during movement of the loaded spoon 10 to a user's mouth (recalling arrow 32 of FIG. 2), the present invention uses a rotational and clutching mechanism or assembly 24 having the following attributes in combination:

- clutching in response to a very slight axial motion of the bowl portion 26 toward handle portion 18 at the beginning of the scooping motion;
- maintenance of clutching in opposition to clockwise torque during the scooping motion (recalling arrow 22 of FIG. 1) for a right-handed spoon (or in opposition to counter-clock wise torque for a left-handed spoon);
- immediate unclutching when the scooping motion is completed (i.e., by clearing of the spoon from the food 12) in response to cessation of the prevailing scooping torque applied by the user on the spoon handle, and in response to a possible combination of a "wedging" gravitational vector along with an opposite torque (i.e., opposite to the scooping torque) which results from the weight of the spoon bowl and food thereon acting through a lever arm "y"; followed by
- free rotational motion (i.e., leveling) of the bowl 26 relative to handle 18 during transport of the loaded spoon to the user's mouth (recalling arrow 32 of FIG. 2).

Figure 3:
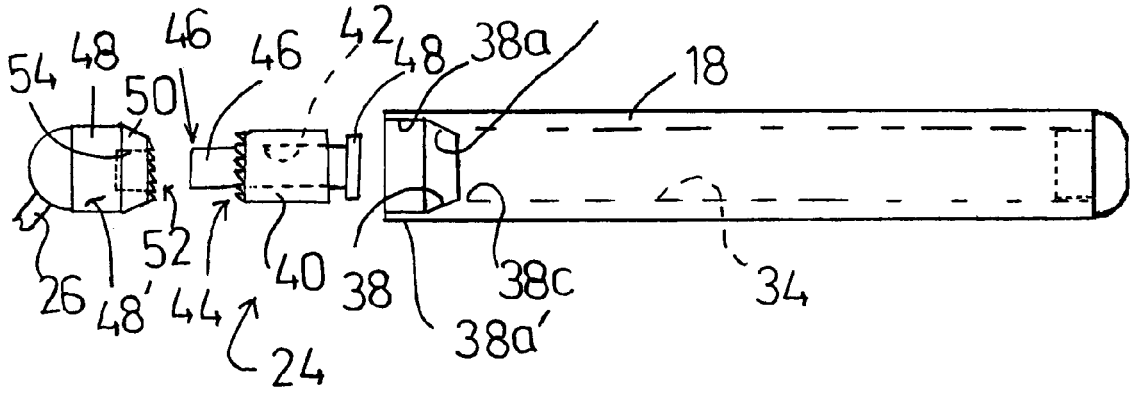
FIG. 3 is an exploded side elevation view, partially in cross section, and at an enlarged size compared to FIGS. 1 and 2, of an improved spoon according to this invention.

Considering FIGS. 3–5 in combination, it is seen that the present invention achieves these objectives and actions by use of a structure that is robust, exceedingly simple mechanically with a minimum of parts, and which also utilizes a unique structure utilizing a combination of physical effects to achieve its operation. Turning first to FIG. 3, it is seen that the handle 18 is formed of a tubular body preferably having a through bore or passage 34. This passage allows for flushing through of cleaning soap water during washing of the disassembled spoon. As FIG. 2 illustrates, the handle 18 may be partially or fully closed at its proximal end by a cap member 36. In the event that the cap member 36 fully closes the proximal end of handle 18, then this cap member will be made removable to facilitate washing of the spoon as mentioned earlier.

At a distal end of the handle 18 (i.e., the left end of this handle for a viewer of FIG. 3), the handle portion 18 defines a counter bore 38 having a first cylindrical section 38*a*, a conical section 38*b*, and another or inner cylindrical section 38*c*. The section 38*c* may, if desired, extend the length of the spoon handle 18 to define the passage 34, or the passage 34 may be of a smaller size. It will be understood that passage 34 is intended to facilitate ease of washing or cleaning of the spoon 10, and this objective can well be accomplished by disassembly of the spoon for cleaning. Such a disassembly is easily achieved as will be explained. Further, the handle 18 defines a collar section 38*a*' at counter bore 38*a*, which collar section acts somewhat as a shield in cooperation with a carrier member to be described below.

The features of counter bore 38 forms part of the rotational and clutching assembly 24, with the remainder of this mechanism being fitted into the counter bore 38. The mechanism 24 includes a bushing member 40 which at its outer diameter surface is a removable press fit into the counter bore section 38*c*. That is, the bushing 40 may be manually pushed into the bore section 38*c*, and also may be manually pulled from this bore. So, when the bushing 40 is manually (i.e., with finger pressure) pushed into the bore 38*c* it is non-rotational relative to handle portion 28. Although the preferred embodiment has not found it necessary to provide any other coupling mechanism between the busing and the handle 18 beyond the removable press fit mentioned immediately above, those ordinarily skilled in the pertinent arts will understand that the bushing 40 may be keyed to the handle 18. Alternatively, the inner portion 38*c* of counter bore 38 may define a spline configuration and the outer surface of busing 40 define a matching spline shape so that when the bushing is lightly press fitted into the bore 38 the bushing 40 and handle 18 are positively non-rotational relative to one another. Removal of the bushing member 40 (along with the other elements of the rotational and clutching mechanism 24) outwardly distally of the handle 18 exposed the mechanism 24 and provides for cleaning of the mechanism of spoon 10 as described above, even if the passage 34 is not provided though handle 18.

Bushing member 40 defines a through bore 42. At its distal axial end surface, the busing member 40 defines a circular array of fine-dimension axial ratchet teeth, generally indicated with the arrowed numeral 44 in FIG. 3. Rotationally received through bore 42 with a determined radial clearance (i.e., resulting in a determined degree of freedom to cant or wobble in the bore 42) is a headed shaft member 46. That is, the shaft member 46 includes a head portion 48 and a distally extending cylindrical portion 46'. Non-rotationally received permanently on the distal portion 46' of shaft member 46 is a carrier member 48. This carrier member 48 carries the shaft 26' of spoon bowl 26. Also, this carrier member 48 defines a cylindrical section 48' which is received into section 38*a* of counter bore 38 with a radial clearance somewhat greater than the radial clearance between shaft member 46 and bore 42 of bushing member 40. Thus, the carrier member 48 at surface 48' is closely spaced from the collar 38' and these elements cooperatively form a shield resisting entry of food particles into the mechanism 24. That is, integral parts of the handle 18 and of carrier member 48 serve as a self-formed shield structure to resist entry of food particles into the rotational and clutching mechanism.

Carrier member 48 also defines a conical wedging surface 50 substantially matching in angle the conical section 38*b* of counter bore 38. Also, at its proximal axial end surface, the carrier member 48 defines a circular array of fine-dimension axial ratchet teeth, generally indicated with the arrowed numeral 52 in FIG. 3. The ratchet teeth 44 and 52 are angulated in opposite directions, and for a right-handed spoon 10 are arranged to sustain clock-wise torque applied at handle 18 and reacted at spoon bowl 26, as is best seen in FIGS. 4 and 5. For a left-handed spoon 10, the ratchet teeth 44 and 52 are arranged oppositely. Within the array of ratchet teeth 52, the carrier member 48 defines a blind bore 54 permanently receiving the end portion 46' of shaft member 46. That is, the end portion 46' may be permanently secured into bore 54 by use of an epoxy adhesive, for example.

Considering now the details revealed in FIG. 5, it is seen that the ratchet teeth 44 and 52 are of fine dimension. That is, these ratchet teeth are only about 0.015 inch deep (dimension "x" on FIG. 5). Thus, an axial motion of just slightly more than 0.015 between the bushing member 40 and carrier member 48 is sufficient to fully engage or disengage the ratchet teeth 44 and 52 with or from one another. Further, the ratchet teeth 44 and 52 have a very shallow ramp angle (angle $\alpha$ on FIG. 5) so that a very slight torque in the direction opposite to that sustained by the ratchet teeth (i.e., counterclockwise in the case of a right-handed spoon) is sufficient to make the ratchet teeth 44 and 52 disengage from one another. Most preferably, the angle $\alpha$ is about 15°. So, viewing FIG. 5 it is seen that the ratchet teeth 44 each have an engagement surface 44*a*, and a sloped back or ramp surface 44*b*. The ratchet teeth 52 on carrier member 48 similarly have engagement surfaces 52*a* and back or ramp surfaces 52*b*.

Further, now viewing FIG. 4, it is to be understood that the sequence of events during scooping of food with the spoon 10 first results in a slight axial motion 56 (recalling axial forces 16 and 28 illustrated on FIG. 1, as the spoon is pushed into the food 12 (or along the bottom of the plate or bowl containing the food 12). This slight axial motion 56 is sufficient to both engage the ratchet teeth 44 and 52 with one another, as well as to engage the conical surface 50 onto the matching surface 38*b*. Because the ratchet teeth 44 and 52 are engaged, the torque 22 is sustained, and the spoon 10 is effective to scoop up food. However, as soon as the spoon bowl 26 clears the food 12, a combination of factors is effective to declutch the mechanism 24 (i.e., to disengage the ratchet teeth 44 and 52) and to make the spoon bowl 26 freely pivotal like a pendulum below axis 18'. That is, the weigh of the spoon bowl 26 and the weight 30 of food therein is effective to produce a counterclockwise torque on the carrier 48, indicated by arrow 58 in FIG. 4.

This torque 58 acts along the shallow back faces of the ratchet teeth 44 and 52, tending force the carrier 48 axially away from bushing 40 so as to unclutch the ratchet teeth. Further, the selected radial clearance of shaft member 46 in bushing 40 allows the carrier member 48 to tilt or cant downward slightly in response to the weight of the spoon bowl portion 26 as well as in response to the weight 30 of food therein, this canting being indicated by arcuate arrows 60 on FIG. 4. The result of this canting of shaft 46 is that the conical wedging surface 50 engages the lower extent of surface 38*b*, as is indicated by arrow 62 on FIG. 4, and is effective to provide an axially directed wedging force 64. So, it is seen that the mechanism 24 accomplished two forces in combination tending to disengage the ratchet teeth 44 and 52. One force is a torque, and the other is a linear vector, both resulting from gravity acting on the spoon bowl 26 and food thereon. In combination, the torque effect discussed earlier and the wedging effect are sufficient to overcome static friction of the shaft member 46 in bushing 40, resulting in the shaft member 46 moving slightly forward axially, unlatching the ratchet teeth.

Both of these forces (i.e., torque force and downward gravity vector force from weight 30 originate with gravity but are applied differently because the vector force is assisted by the wedging effect of surface 50 engaging and sliding slightly along surface 38*b*. The result is an almost immediate and imperceptible transition of the spoon bowl 26 from a clutched condition to an unclothed and freely pivotal condition, in which the spoon bowl is self-leveling to better retain food thereon. Even though the weight of the spoon bowl 26 itself and the weight 30 of food thereon is not great, the unclutching action accomplished by the present invention is positive and reliable. Importantly, the torque effect and vector effect together are very effective to overcome static friction and to (once motion begins) to convert the frictional relationship of shaft 46 with bushing 40 to one of dynamic friction. Thus, "stiction" of the spoon bowl in one rotational position is avoided, and the spoon bowl 26 pivots freely like a pendulum below axis 18'. It follows that the spoon 10 automatically levels and substantially retains food thereon, so as to provide a person with undeveloped or impaired coordination a useful improvement in their ability to feed themselves.

Further, the materials of construction for the components of the spoon 10 are preferably selected to allow inexpensive and simplified manufacture while still permitting extended use of the spoon 10. For example, the components of the spoon 10 may be formed from injection moldable plastics approved by the FDA for use in making eating utensils or from metals such as stainless steel. The chosen materials of construction are preferably dishwasher or sterilizer safe.

It will also be appreciated that features of the one preferred exemplary embodiment typically may be applied to another embodiments. The various features described herein may be used singly or in any combination thereof. Therefore, the present invention is not limited to only the embodiment specifically described herein.

While the foregoing description and drawings represent a preferred embodiment of the present invention, it will be understood that various additions, modifications and substitutions may be made therein without departing from the spirit and scope of the present invention as defined in the accompanying claims.

What is claimed is:

1. An improved spoon comprising:

an elongate handle portion defining a longitudinal axis;

a spoon bowl portion having a shaft part;

a rotational and clutching apparatus connecting said handle portion and said spoon bowl via said shaft part so that the spoon bowl is relatively rotationally supported below said longitudinal axis, said rotational and clutching apparatus further being responsive to a certain user input to clutch said spoon bowl to said handle portion to resist torque in only a single direction, and said rotational and clutching apparatus being responsive to torque in an opposite direction to unclutch allowing said spoon bowl to freely rotate about said longitudinal axis.

2. The improved spoon according to claim 1, wherein said certain user input includes application by a user of an axial force along said handle such that the spoon bowl reacts axially against an object to move axially toward said handle portion, whereby reaction of the spoon bowl against an object such as a plate or food is sufficient to effect clutching of the spoon bowl to the handle portion.

3. The improved spoon according to claim 2 wherein said rotational and clutching apparatus provides for said spoon bowl to move a determined direction axially of said longitudinal axis relative to said handle portion.

4. The improved spoon according to claim 3 wherein said rotational and clutching apparatus includes a bushing member and a shaft member rotationally and axially movably associated with one another, each of said bushing member and said shaft member further being drivingly connected to a respective one of a pair of circular arrays of ratchet teeth, and said pair of circular arrays of ratchet teeth drivingly engaging one another to sustain torque in one direction in response to axial relative movement of said shaft member and bushing member, whereby, said pair of circular arrays of ratchet teeth disengage in response to torque in the opposite direction.

5. The improved spoon according to claim 4 wherein said pair of circular arrays of ratchet teeth are each axially disposed ratchet teeth axially engageable with one another.

6. The improved spoon according to claim 5 wherein said pair of circular arrays of ratchet teeth are fine-dimension ratchet teeth, whereby, either one or both of a slight axial relative motion of said bushing and shaft is sufficient to engage or disengage said fine-dimension ratchet teeth, or when engaged a slight torque in the opposite direction is enough to cause said fine-dimension ratchet teeth to disengage by wedging each other apart axially.

7. The improved spoon according to claim 6 wherein each tooth of said pair of fine-dimension circular arrays of ratchet teeth have a radially and axially disposed engagement surface, each engageable with a like engagement surface of a ratchet tooth of the other of said pair of circular arrays of ratchet teeth, and a back surface extending radially, axially and circumferentially, whereby confronting back surfaces of said pair of circular arrays of ratchet teeth function to wedge said ratchet teeth out of engagement in response to a torque in said opposite direction.

8. The improved spoon according to claim 4 wherein said bushing member and said shaft member cooperatively define a determined radial clearance, whereby said shaft member is both rotationally and axially movably associated with said bushing member, and said shaft member may also cant within said bushing member.

9. The improved spoon according to claim 8 further including a carrier member carried by one of said bushing member and shaft member, the other of said bushing member and shaft member being carried by said handle portion, said carrier member carrying said spoon portion via said shaft part; and a pair of conical wedging surfaces one associated with each of said carrier member and said handle portion, and said pair of conical wedging surfaces closely confronting one another in response to axial motion of said shaft member and bushing member effecting clutching engagement of said pair of circular arrays of ratchet teeth, whereby, said pair of conical wedging surfaces engage one another in response to canting of said shaft member within said bushing member in order to provide an axial force directed axially to disengage said pair of circular arrays of ratchet teeth.

10. The improved spoon according to claim 9 wherein said carrier member defines a male one of said pair of conical wedging surfaces, and said handle portion defines a female one of said pair of conical wedging surfaces.

11. The improved spoon according to claim 10 wherein said handle portion also includes an axially extending collar feature extending axially partially over said carrier member with a selected radial clearance sufficient to allow canting of said shaft member within said bushing member, whereby said collar feature serves to shield said bushing member, said shaft member, and said pair of circular arrays of ratchet teeth from contamination by food.

12. The improved spoon according to claim 9 wherein said carrier member defines one of said circular arrays of ratchet teeth, and said bushing member defines the other one of said pair of circular arrays of ratchet teeth.

* * * * *